US005448950A

United States Patent [19]

Lowder et al.

[11] Patent Number: 5,448,950

[45] Date of Patent: Sep. 12, 1995

[54] COMPACT DISC IDENTIFICATION STAMP

[76] Inventors: Ernest E. Lowder, 132 Rivermount Ter., Unit #1, Burlington, Vt. 05401; Donald W. Meeker, 412 N. Coast Hwy., Laguna Beach, Calif. 92651

[21] Appl. No.: 295,105

[22] Filed: Aug. 24, 1994

[51] Int. Cl.[6] ..... B41K 1/42

[52] U.S. Cl. ..... 101/333; 101/368

[58] Field of Search ..... 101/327, 333, 368, 372, 101/373, 405, 406

[56] References Cited

U.S. PATENT DOCUMENTS

| | | | |
|---|---|---|---|
| 316,268 | 4/1885 | Horner | 101/333 |
| 2,234,422 | 3/1941 | Wiswell | 101/333 |
| 2,443,783 | 6/1948 | Bogin et al. | 101/327 |
| 2,664,820 | 1/1954 | Brown, Jr. | 101/405 |
| 2,900,902 | 8/1959 | Becker | 101/327 |
| 3,158,094 | 11/1964 | Harris et al. | 101/327 |
| 3,215,073 | 11/1965 | Robinson | 101/333 |
| 3,491,719 | 10/1970 | Rudy | 101/327 |
| 3,522,769 | 8/1970 | Priesmeyer | 101/327 |
| 4,070,967 | 1/1978 | Schlau et al. | 101/333 |

FOREIGN PATENT DOCUMENTS

| | | | |
|---|---|---|---|
| 242197 | 11/1925 | United Kingdom | 101/333 |

*Primary Examiner*—Eugene H. Eickholt
*Attorney, Agent, or Firm*—Donald W. Meeker

[57] ABSTRACT

Two stamping components are centrally and axially aligned to insure an exact repeatable register between a stamping head and a compact disc. A rigid D-shaped post protruding from one stamping component engages a mating D-shaped opening recessed in another stamping component to align a stamping head with a compact disc. A recess in a casing retains and positions the compact disc. Movable rubber type positioned in an annular groove in the stamping head impart identifying inked insignia to the compact disc around the central opening of the disc. The stamping head may have a central D-shaped opening to receive a rigid D-shaped post from the compact disc positioner. Alternatively, the stamping head may have a central rigid D-shaped post to engage a mating central D-shaped opening alternately in the compact disc positioner. A circular stamp pad admits the stamping head. For a stamping head with a protruding post, the stamp pad has a mating recessed opening to receive the post. Stacked trays and a cover form a casing to house a separate stamping head and built-in disc positioner and ink pad and rubber type storage area. Alternatively, a hinged casing has a built-in stamping head in the cover to engage alternately a built-in ink pad in the base and a compact disc placed in a disc positioning area over the ink pad. With a stamping head having a protruding rigid D-shaped post, a standard "jewel box" compact disc container with a central ring of prongs may serve to position the compact disc for alignment with the stamping head, aligning the flat on the D-shaped post with the prongs.

20 Claims, 2 Drawing Sheets

COMPACT DISC IDENTIFICATION STAMP

BACKGROUND OF THE INVENTION

1. Technical Field

The present invention relates to marking devices and in particular to a stamping device for identifying compact discs with two mating stamping components having a built-in centering and axial alignment means, inking means, and changeable type.

2. Description of the Prior Art

Compact disc ownership may be identified by a label stuck onto a compact disc "jewel box" carrying case. But often the compact discs are separated from their jewel box case at a party where discs may be stacked on a compact disc player or when carrying the compact discs in disc carriers with pockets. When compact discs are loaned to others, there is often the possibility of confusing who owns what disc. With increased applications of compact discs including music discs, video discs, and computer discs, there is a growing need for identifying compact discs.

The compact discs when used are sometimes required to fit and spin within a very confined space which will not allow a label to be attached to the surface of the compact disc. Some other means of identification must be used that will not protrude from the surface of the compact disc.

Prior art U.S. Pat. No. 1,412,300 shows a device for marking phonograph records with a stamping head having a retractable center post or pin 8 with a coil spring 9 which allows the post or pin to retract for inking the stamping head. This retractable post or pin is designed to retracet upon engaging an ink pad to allow the stamping head to engage the ink pad, but the retractable pin would also retract upon contacting a surface of the record and would not function properly to locate the center hole in the phonograph record since the post or pin could just retract when contacting the surface of the phonograph record in any position, so that the stamping head would not be aligned properly with the phonograph record, which could result in marking the wrong location on the phonograph record and possibly damaging the record. No provision is made for axial alignment to insure an exact and repeatable registratin of the stamp with the disc for re-inking the information. No provision is made for positioning the record.

DISCLOSURE OF INVENTION

The present invention provides a rubber stamp device for compact discs, having two mating stamping components (stamping head and compact disc positioner) with a means for centrally positioning the compact disc and means for centrally and axially aligning the stamping head with the central opening in the compact disc and with the stamping pad to ensure a clearly legible indicia without danger of marking the compact disc incorrectly or damaging the disc. The cental and axial alignment ensures an exact repeatable registration with no horizontal movement and no rotation so that the compact disc can be re-inked with the same information in the same position on the compact disc.

In one stamping component a shallow circular recessed area provides a means for positioning and retaining the compact disc in a desired stationary orientation centrally located relative to the interconnection with the stamping head component.

In the preferred embodiment,and alternate embodiments having hand-held stamping heads, a rigid D-shaped post in one stamping component and a mating D-shaped opening recessed in the other stamping component align with the central opening in the compact disc to insure a central and axial alignment of the stamping head with the compact disc. In an alternate embodiment, the stamping head is attached to the cover of a hinged case while the mating and aligned compact disc positioning means is in the base of the hinged case. The hinged connection of the two components ensures exact repeatable registration of the stamping head on the compact disc and a rigid post in one component and mating recessed opening in the other component further ensures exact alignment. The rigid post in all of the components engages the opening in the compact disc ensuring that the stamping head will not contact the playing area of the compact disc.

In the hinged case embodiment of the invention, the stamping head is fit into the case cover. The stamping head may be moved to contact alternately the inked stamp pad and the compact disc to ink the disc. The case cover may be flexible to allow the movement of the stamping head, or the stamping head may fit movably within an opening in the case cover and include a spring between the case cover and the stamping head, or the case cover may have a slotted hinge enabling movement of the case cover relative to the case bottom holding the stamp pad and the compact disc.

The present invention provides a changeable rubber stamp compact disc identification device which enables compact discs to be permanently stamped with any desired identifying indicia on the clear area immediately surrounding the central opening of the compact disc between the opening and the playing area.

An annular recessed area on a stamping head allows any combination of changeable indicia, preferably in the form of movable rubber stamp letters, numbers, and symbols, to be friction fit into the annular recessed area with the tops of the changeable indicia protruding from the stamping head to engage alternately an inked stamp pad and a compact disc for stamping the identifying indicia on the compact disc. Ridges in the annular recessed area assist in properly aligning the movable rubber stamp indicia. Surplus changeable indicia may be stored either in the case or in a hollow handle of a stamping device having a handle along with a flexible tweezer-type tool for manipulating the changeable indicia.

BRIEF DESCRIPTION OF THE DRAWINGS

These and other details and advantages of our invention will be described in connection with the accompanying drawings, which are furnished only by way of illustration and not in limitation of the invention, and in which drawings.

BEST MODE FOR CARRYING OUT THE INVENTION

Figure 1:
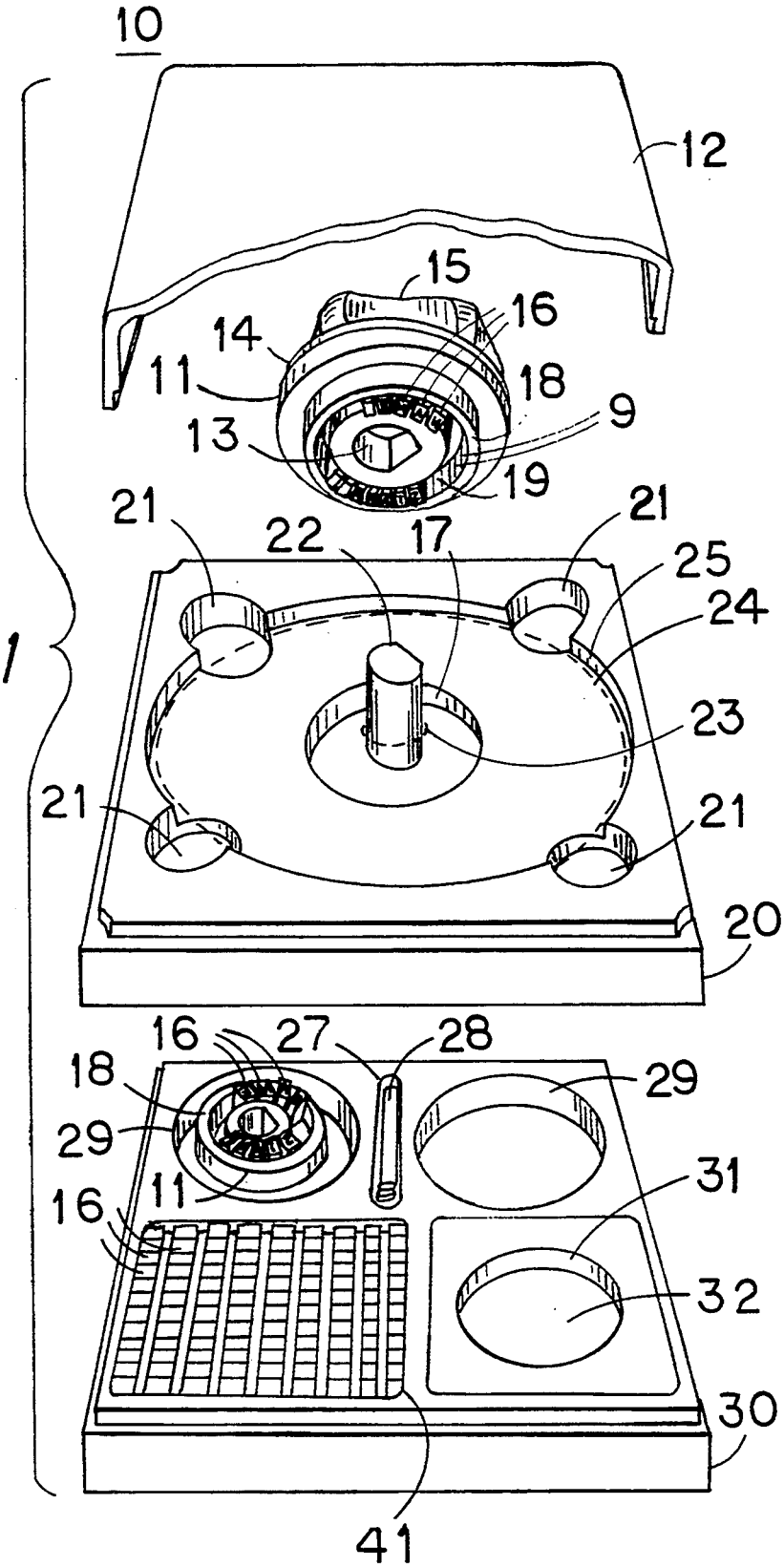
FIG. 1 is an exploded partial perspective view showing the components of the preferred embodiment of the invention with stacking trays aligned for assembly.

In FIG. 1 a preferred embodiment of an identification stamping device 10 for compact discs comprises a casing means 12, 20, and 30 for housing a stamping device for compact discs. Two mating stamping components ensure centering and axial alignment of the stamping head with the compact disc. The first stamping component, a stamping head 14 is housed within the casing means, which stamping head comprises a flat circular stamping face 18 with stamping indicia 16 protruding from the stamping face in an annular configuration and a knob handle 15 means for pressing the stamping face against a compact disc 24 (shown dashed). The second stamping component, a compact disc positioning means 25 having a flat circular recessed surface for receiving and centering a compact disc is built into the casing means. Protruding from the center of the circular recessed surface, a rigid D-shaped post positive engaging post 22 passes through the central opening 23 in the compact disc and mates with a D-shaped opening 13 recessed in the center of the stamping head 11 to center and axially align the two stamping components so that the stamping indicia may be accurately aligned centrally and axially with a circular band on a compact disc between the central opening in the compact disc and the playing area of the compact disc. An inked stamp pad 32 is built into the casing means, wherein the inked stamp pad comprises a circular opening 29 means to accommodate the outside diameter of the stamping head 11 for aligning the stamping face with the stamp pad.

An annular recess 19 in the stamping face receives changeable indicia 16 which protrude in an annular pattern out of the annular recess beyond the flat stamping face 18. The changeable indicia 16 preferably comprise movable rubber stamp type comprising letters, numbers, and symbols. The casing means further comprises a compartment 41 built into the casing with rows of parallel grooves for receiving and storing surplus changeable indicia 16. A flexible tweezer-type tool 28 for manipulating the changeable indicia is stored within a recessed groove 27 in the casing which serves as a receptacle for storing tweezer-type tool.

In the preferred embodiment of FIG. 1, the stamping head 14 comprises a hand-held knob 15 which receives removable interchangeable stamping faces 11 containing the movable indicia 16. The primary stamping head 14 may be stored in the top tray 20 under the cover 12 and additional interchangeable stamping faces 11 with other identifying names may be stored in the bottom tray 30 in circular recesses 29. Alternately, the knob 15 may be stored in one circular recess and the stamping face in another.

A series of ridges 9 protrude around at least one wall of the annular recess 19, which series of ridges serve to align the changeable indicia on the annular recess.

Figure 2:
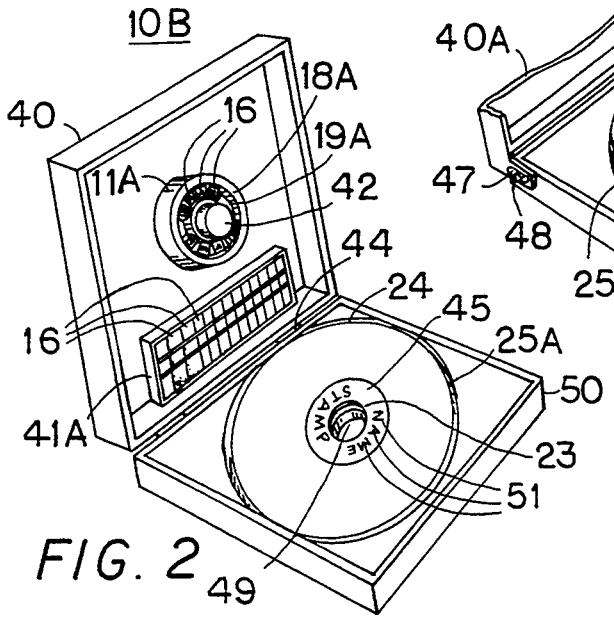
FIG. 2 is a perpective view of an alternate embodiment of the invention having the stamping head built into the hinged cover of the case.
Figure 3:
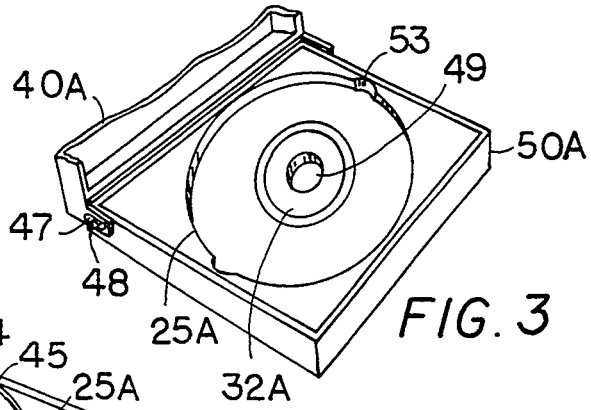
FIG. 3 is a partial perspective view of an alternate embodiment of the invention with a slotted hinged case.

The stamp pad 32 is built into the bottom tray 30 and a circular stamping head sized opening 31 in the pad cover serves as the means for aligning the stamping face with the stamp pad for proper inking of the In FIGS. 2 and 3 an alternate embodiment of the invention comprises a hinged case, wherein the stamping head 11A is attached to a hinged cover 40 of the casing means and the compact disc receiving means 25A, a CD size circular recess, is attached to a base 50 of the casing. The cover 40 and the base 50 are hinged together to form a closable case, which serves as the means for centering and axially aligning the two stamping components. An additional means to ensure centering the stamping head 11A with respect to a central opening 23 in the compact disc comprises a rigid stationary post 42 approximately equal diameter to a diameter of the central opening 28 in the compact disc 24. The rigid stationary post 22 protrudes from the center of the stamping face 18A so that the post inserts into the central opening 23 in the compact disc. The flat circular recessed surface 25A to receive the CD further comprises a central opening 49 in the recessed surface sufficiently large to receive the post.

An shown in FIG. 3, a circular inked stamp pad 32A is secured in the center of the flat circular recessed surface 25A of the compact disc receiving means with a top surface of the stamp pad recessed below the flat circular recessed surface. The stamp pad 32A is sufficiently large to receive the stamping head 11A and the central opening 49 in the recessed area and in the stamp pad is sufficiently large to receive the rigid post 42 from the stamping face to align the stamping head with the pad for inking the indicia 16 in the annular recess 19A of the stamping head. Closing the cover 40 with no compact disc inside the casing (as in FIG. 3) inks the stamping head and alternately closing the cover with a compact disc 24 inside the casing (as in FIG. 2) inks the compact disc with identifying inked insignia 51.

In FIG. 2, the cover 40 is flexible allowing the stamping head 11A to move toward the stamp pad and alternately toward a compact disc positioned in the compact disc positioning means by pressing down on the cover. Alternately, the stamping head may fit movably within an opening in the cover with a spring (not shown) connecting the stamping head to the cover.

In FIG. 3, the cover 40A has a slotted hinge with a slot 47 movable on a pin 48 to enable the cover 40A and stamping head to move toward the stamp pad and alternately toward a compact disc within the casing means. Finger slots 53 facilitate insertion and removal of the CD.

Figure 4:
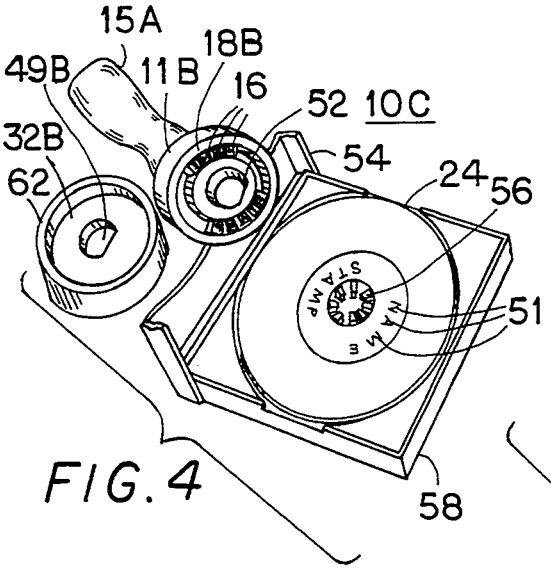
FIG. 4 is an exploded partial perspective view of an alternate embodiment of the invention having a long-handled stamp head with a protruding post.

In FIG. 4 an alternate embodiment of the invention 10C has a long-handled 15A stamping head width a D-shaped rigid post 52 protruding from the center of the stamping face 18A. In this embodiment with a freely movable stamping head, the compact disc receiving means may comprise a standard compact disc carrying case 58 and the post fits within a central opening in a central compact disc retainer 56 in the carrying case. The retainer 56 comprises an annular ring of flexible prongs which engage the central opening in the compact disc. Alignment of the flat on the D-shaped post 52 with the prongs on the compact disc retainer ensures axial alignment as well an centering between the two stamping components. A cap 62 for the stamping head contains an ink pad 32B with a central D-shaped pad opening 49B to admit the rigid D-shaped post 52 from the stamping head to align the stamping head with the ink pad for proper inking.

Figure 5:
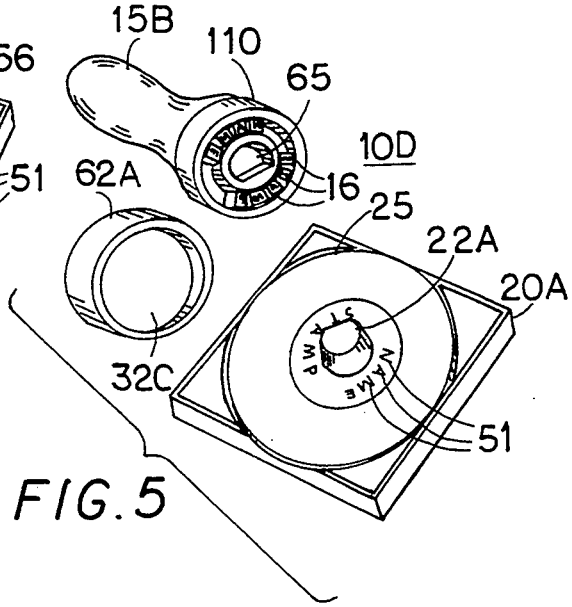
FIG. 5 in an exploded perspective view of an alternate embodiment of the invention having a long-handled stamp head with a central opening to receive a post built into the CD receptacle in the case.

In FIG. 5 another alternate embodiment with a long-handled 15B stamping head is provided with a central D-shaped opening 65 in the center of the stamping head 11C to admit and align centrally and axially with a rigid mating D-shaped post 22A built into the compact disc positioning area of the case 20A for stamping the compact disc 25. A stamping head cap 62A has a circular stamp pad 32C sufficiently large in diameter to admit the stamping head 11C for alignment and proper inking of the stamping head 11C.

In all of the embodiments, upon aligning the stamping head with the compact disc and pressing the stamping head against the disc, the inked indicia 16 of the stamping head impart identifying inked insignia 51 on an annular portion of the compact disc between the central opening 23 of the disc and the playing portion of the disc. Exact re-inking is possible because of the centering and axial alignment of the two stamping components.

Molded plastic is the preferred fabricating means and inked movable rubber stamps are the preferred marking means.

It is understood that the preceding description is given merely by way of illustration and not in limitation of the invention and that various modifications may be made thereto without departing from the spirit Of the invention as claimed.

We claim:

1. An identification stamping device for compact discs comprising a casing means for housing a stamping device for compact discs;

two mating stamping components;

wherein a first stamping component comprises a stamping head housed within the casing means, which stamping head comprises a flat circular stamping face with stamping indicia protruding from the stamping face in an annular configuration and a means for pressing the stamping face against a compact disc;

wherein a second stamping component comprises a compact disc positioning means having a flat circular recessed surface for retaining and centering a compact disc;

a positive engaging means communicating between the mating stamping compenents for centering and axially aligning the two mating stamping components so that the stamping indicia may be accurately aligned and registered with a circular band on a compact disc between the central opening in the compact disc and a playing area of the compact disc;

an inked stamp pad built into the casing means, wherein the inked stamp pad comprises a means for aligning the stamping face with the stamp pad.

2. The invention of claim 1 wherein the stamping head further comprises an annular recess in the stamping face to receive changeable indicia which protrude in an annular pattern out of the annular recess beyond the flat stamping face.

3. The invention of claim 2 wherein the changeable indicia comprise movable rubber stamp type comprising letters, numbers, and symbols.

4. The invention of claim 3 wherein the casing means further comprises a compartment for receiving and storing surplus changeable indicia.

5. The invention of claim 4 further comprising a flexible tweezer-type tool for manipulating the changeable indicia, wherein the casing means comprises a receptacle for storing the tweezer-type tool.

6. The invention of claim 5 wherein the stamping head comprises a hand-held knob which receives removable interchangeable stamping heads.

7. The invention of claim 5 wherein the casing means comprises a cover over a first tray housing the compact disc receiving means and a second tray stacked below the first tray, wherein the second tray houses the stamp pad, the indicia, the tweezer-type tool, and stamping heads.

8. The invention of claim 4 further comprising a series of ridges protruding around at least one wall of the annular recess, which series of ridges serve to align the changeable indicia on the annular recess.

9. The invention of claim 1 wherein the means for centering and axially aligning the two mating stamping components comprises a rigid stationary D-shaped post, on one of the two mating stamping components, which D-shaped post is approximately equal in diameter to a diameter of the central opening in the compact disc, and a mating D-shaped opening on the other of the two mating stamping components.

10. The invention of claim 9 wherein the rigid stationary D-shaped post protrudes from the center of the stamping face so that the post inserts into the central opening in the compact disc.

11. The invention of claim 10 wherein the compact disc positioning means comprises a standard compact disc carrying case with a central ring of prongs for retaining a compact disc in place and the D-shaped post fits within the ring of prongs with a flat portion of the D-shaped post aligned between two of the prongs.

12. The invention of claim 10 wherein the compact disc positioning means is built into the casing means and the flat circular recessed surface further comprises a central mating D-shaped opening in the recessed surface sufficiently large to receive, center, and axially align the D-shaped post.

13. The invention of claim 10 wherein the means for aligning the stamping face with the stamp pad comprises a central D-shaped opening recessed in the stamp pad sufficiently large to admit the D-shaped post from the stamping face to align the indicia for proper inking.

14. The invention of claim 9 wherein the compact disc positioning means is built into the casing means and the rigid stationary D-shaped post protrudes from the center of the flat circular recessed surface, wherein the stamping head further comprises a mating central D-shaped opening in the stamping face sufficiently large to receive and axially align with the rigid stationary D-shaped post.

15. The invention of claim 14 further comprising a cover over the stamp pad, wherein the means for aligning the stamping face with the stamp pad comprises a central opening in the stamp pad cover sufficiently large to admit and align the stamping face for proper inking of the indicia.

16. The invention of claim 1 wherein the stamping head is attached to a cover of the casing means and the compact disc positioning means is attached to a base of the casing and the means for centering and axially aligning the two mating stamping components comprises hinges connecting the cover and the base to form a closable case, which comprises the casing means.

17. The invention of claim 16 wherein the circular inked stamp pad is secured in the center of the flat circular recessed surface of the compact disc positioning means with a top surface of the stamp pad recessed below the flat circular recessed surface, wherein the stamp pad is sufficiently large to receive the stamping face for inking the indicia and closing the cover with no compact disc inside the casing inks the stamping face and alternatively closing the cover with a compact disc inside the casing inks the compact disc.

18. The invention of claim 17 wherein the cover is flexible allowing the stamping face to move toward the stamp pad and alternately toward a compact disc positioned in the compact disc positioning means by pressing down on the cover.

19. The invention of claim 17 wherein the stamping head fits movably within an opening in the cover and a spring connects the stamping head to the cover.

20. The invention of claim 17 wherein the cover has a slotted hinge to enable the cover and stamping head to move toward the stamp pad and alternately toward a compact disc within the casing means.

* * * * *